US006305247B1

(12) United States Patent
Chen

(10) Patent No.: US 6,305,247 B1
(45) Date of Patent: Oct. 23, 2001

(54) RATCHET WRENCH STRUCTURE

(76) Inventor: Ching Chen, 1, Nong 2, Lane 741, Dong-Ping Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/756,520

(22) Filed: Jan. 9, 2001

(51) Int. Cl.[7] ..... B25B 13/46
(52) U.S. Cl. ..... 81/60; 81/58
(58) Field of Search ..... 81/60, 58, 61

(56) References Cited

U.S. PATENT DOCUMENTS 4,796,492 * 1/1989 Liou ..... 81/58
6,044,731 * 4/2000 Hsieh ..... 81/60
6,148,695 * 11/2000 Hu ..... 81/60
6,151,993 * 11/2000 Shiao ..... 81/60

* cited by examiner

*Primary Examiner*—James G. Smith
*Assistant Examiner*—Hadi Shakeri
(74) *Attorney, Agent, or Firm*—Charles E. Baxley

(57) ABSTRACT

A ratchet wrench structure includes a wrench body having a head portion defining a receiving space and a receiving chamber, an annular groove defined in the upper edge of the receiving space, an annular toothed block secured in the receiving space, a locking block pivotally mounted in the receiving chamber and provided with a plurality of engaging teeth mating with the annular toothed block, a spring mounted in the receiving chamber and urged between the inner wall of the receiving chamber and a rear end of the locking block, a cover mounted in the receiving chamber and defining an arcuate groove, and a C-shaped snap secured in and retained by the annular groove of the wrench body and the arcuate groove of the cover, and rested on the annular toothed block.

5 Claims, 4 Drawing Sheets

RATCHET WRENCH STRUCTURE

BACKGROUND OF THE INVENTION

1. Field of the Invention

The present invention relates to a ratchet wrench structure, and more particularly to a ratchet wrench structure having a simple construction with fewer parts.

2. Description of the Related Prior Art

A conventional ratchet wrench 10 in accordance with the prior art shown in FIG. 1 comprises a pawl member 11, a ratchet portion 12, a rotation cover 13, a locking ring 14, and screws 15. However, the conventional ratchet wrench 10 has a complicated construction with multiple assembly parts. In addition, it is necessary to additionally provide screws 15 for fixing the locking ring 14 during the assembling and dismantling process of the conventional ratchet wrench, thereby consuming the assembling and dismantling time, and thereby increasing cost of fabrication of the conventional ratchet wrench.

SUMMARY OF THE INVENTION

In accordance with the present invention, there is provided a ratchet wrench structure comprising:

- a wrench body including a head portion defining a receiving space, a receiving chamber defined in the head portion and located beside the receiving space, an annular groove defined in the head portion and located at an upper edge of the receiving space;
- an annular toothed block secured in the receiving space of the wrench body and having an outer periphery provided with a plurality of teeth;
- a locking block pivotally mounted in the receiving chamber of the wrench body and having one side provided with a plurality of engaging teeth mating with the teeth of the annular toothed block;
- a spring mounted in the receiving chamber of the wrench body and having a first end urged on an inner wall of the receiving chamber of the wrench body and a second end urged on a rear end of the locking block;
- a cover mounted in the receiving chamber of the wrench body for covering the locking block and the spring and defining an arcuate groove mating with the annular groove of the wrench body, an inclined face provided on the cover and located under the arcuate groove; and
- a C-shaped snap secured in and retained by the annular groove of the wrench body and the arcuate groove of the cover, and rested on the annular toothed block.

By such an arrangement, the ratchet wrench structure of the present invention can be directly assembled and dismantled by manual work easily and rapidly such that the assembling and dismantling work of the ratchet wrench structure does not need to additionally provide a screw or the like for locking it, thereby facilitating the assembling and dismantling process of the ratchet wrench structure, and thereby greatly saving time for assembling and dismantling the ratchet wrench structure.

In addition, the cost of fabrication of the ratchet wrench structure is greatly decreased.

Further, the ratchet wrench structure of the present invention has a simple construction with fewer parts.

Further benefits and advantages of the present invention will become apparent after a careful reading of the detailed description with appropriate reference to the accompanying drawings.

DETAILED DESCRIPTION OF THE INVENTION

Figure 1:
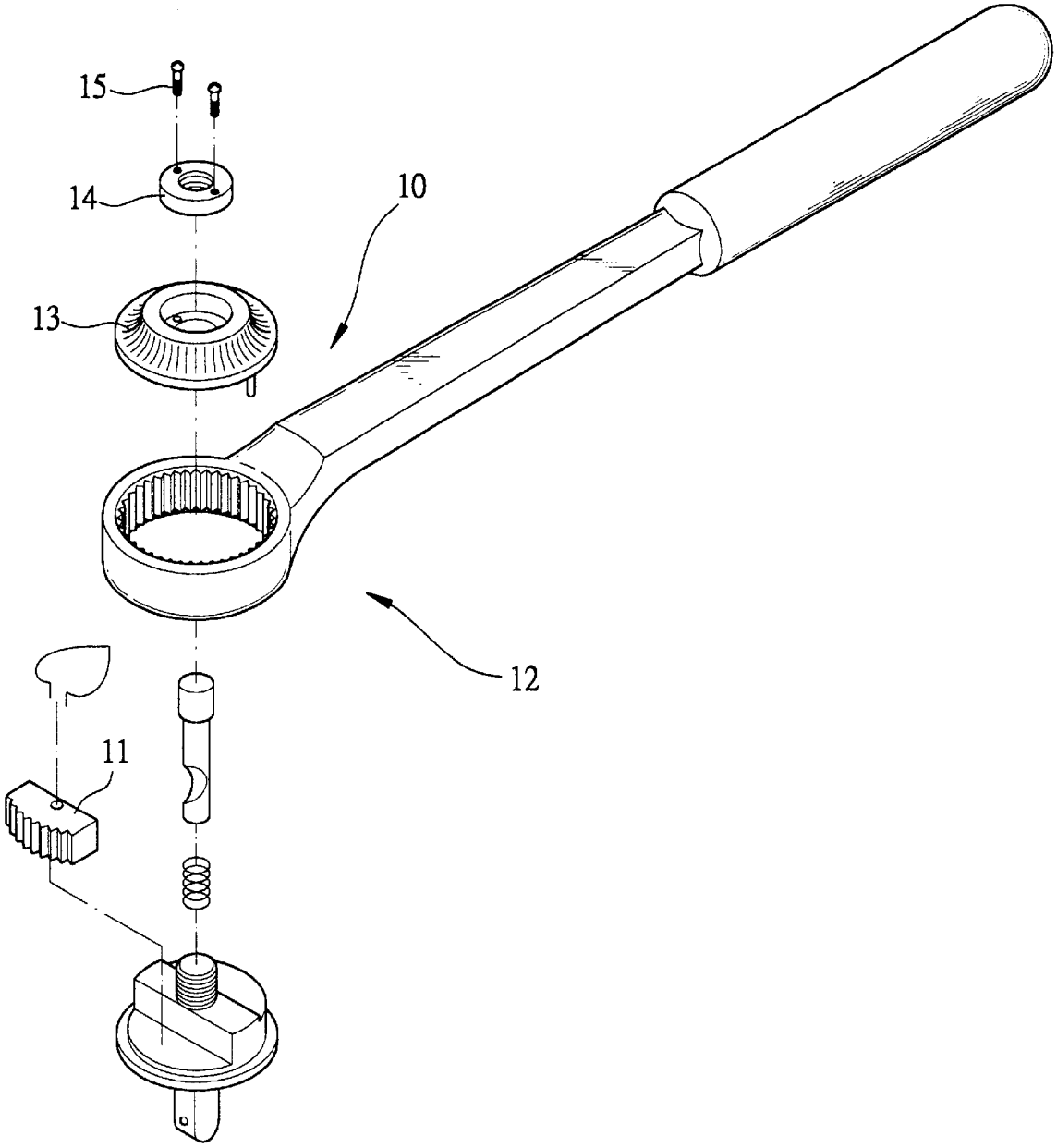
F I G.1 PRIOR ART
FIG. 1 is an exploded perspective view of a conventional ratchet wrench in accordance with the prior art.
Figure 2:
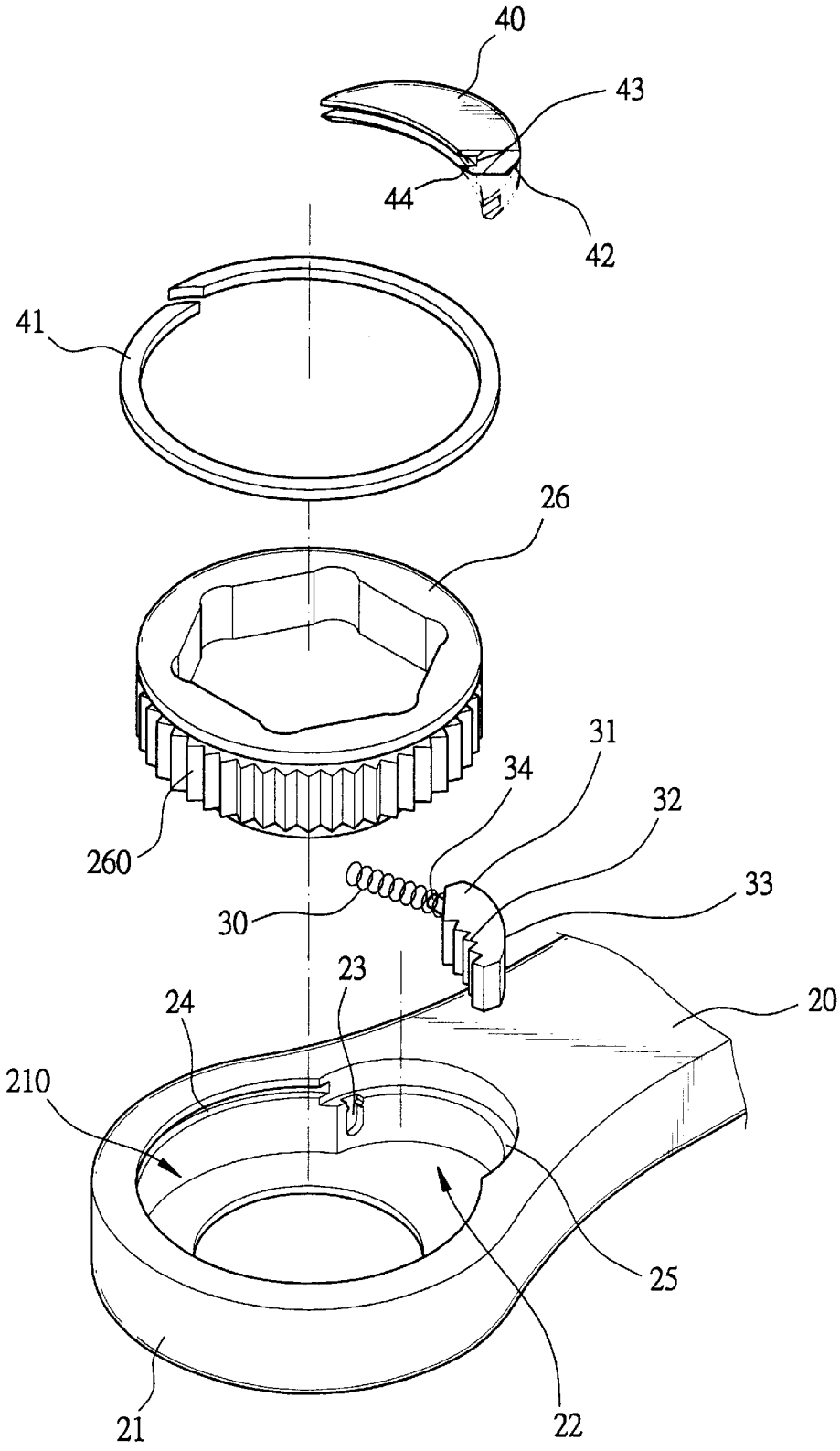
FIG. 2 is an exploded perspective view of a ratchet wrench structure in accordance with the present invention.

Referring to the drawings and initially to FIG. 2, a ratchet wrench structure in accordance with the present invention comprises a wrench body 20, an annular toothed block 26, a locking block 31, a spring 30, an arcuate cover 40, and a C-shaped snap 41.

The wrench body 20 includes a head portion 21 defining a receiving space 210. An arcuate recessed receiving chamber 22 is defined in the head portion 21 and is located beside the receiving space 210. An annular groove 24 is defined in the head portion 21 and is located at the upper edge of the receiving space 210.

The annular toothed block 26 is secured in the receiving space 210 of the wrench body 20 and has an outer periphery provided with a plurality of teeth 260.

The locking block 31 is pivotally mounted in the receiving chamber 22 of the wrench body 20 and has one side provided with a plurality of engaging teeth 32 mating with the teeth 260 of the annular toothed block 26. The locking block 31 has the other side provided with an arcuate face 33 mating with the receiving chamber 22 of the wrench body 20.

The spring 30 is mounted in the receiving chamber 22 of the wrench body 20 and has a first end urged on the inner wall of the receiving chamber 22 of the wrench body 20 and a second end urged on the rear end of the locking block 31. The rear end of the locking block 31 is provided with a protruding stub 34 secured in the first end of the spring 30.

The head portion 21 of the wrench body 20 defines an inclined recess 23 having a predetermined inclined angle and located at one side of the receiving chamber 22 for securing the first end of the spring 30 therein, whereby the spring 30 generates an angled pulling stress or pushing stress by means of the inclined angle of the recess 23 so that the locking block 31 can mate with the annular toothed block 26 more stably.

The arcuate cover 40 is mounted in the receiving chamber 22 of the wrench body 20 for covering the locking block 31 and the spring 30 and defines an arcuate groove 43 mating with the annular groove 24 of the wrench body 20. An inclined face 44 is provided on the cover and located under the arcuate groove 43.

The head portion 21 of the wrench body 20 is provided with a stepped portion 25 located at the upper edge of the receiving chamber 22 for stably supporting the arcuate cover 40. The arcuate cover 40 is provided with an inclined surface 42 located opposite to the inclined face 44 to rest against the stepped portion 25 of the wrench body 20.

The C-shaped snap 41 is secured in and retained by the annular groove 24 of the wrench body 20 and the arcuate groove 43 of the arcuate cover 40, and is rested on the annular toothed block 26.

Figure 3:
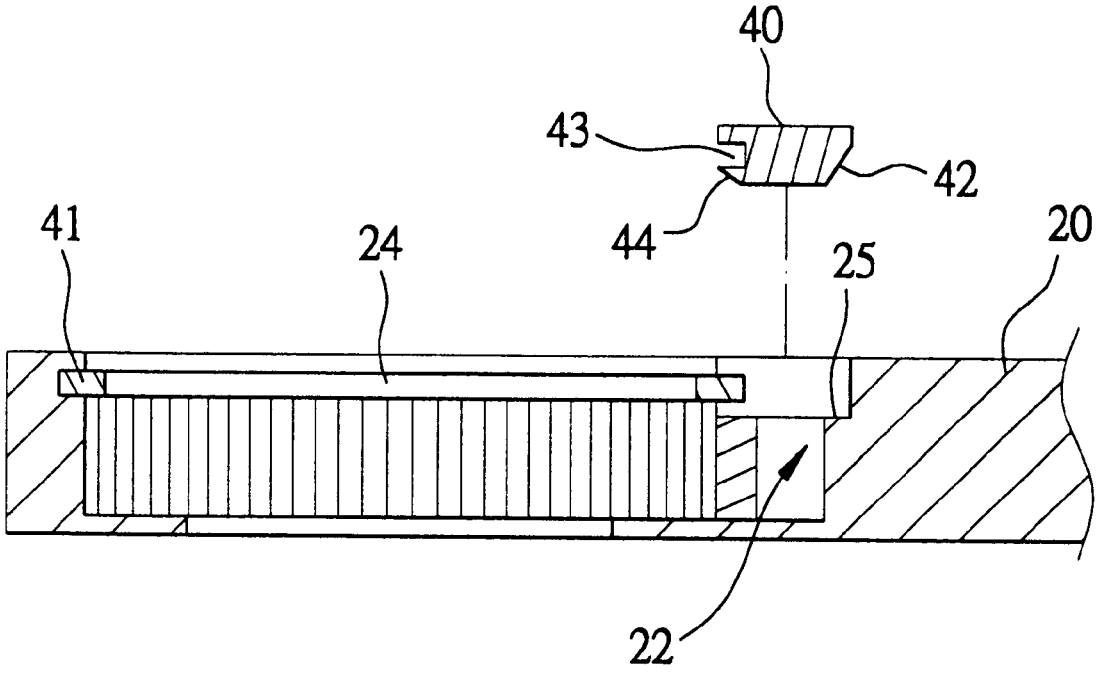
FIG. 3 is a partially side plan cross-sectional assembly view of the ratchet wrench structure as shown in FIG. 1.
Figure 4:
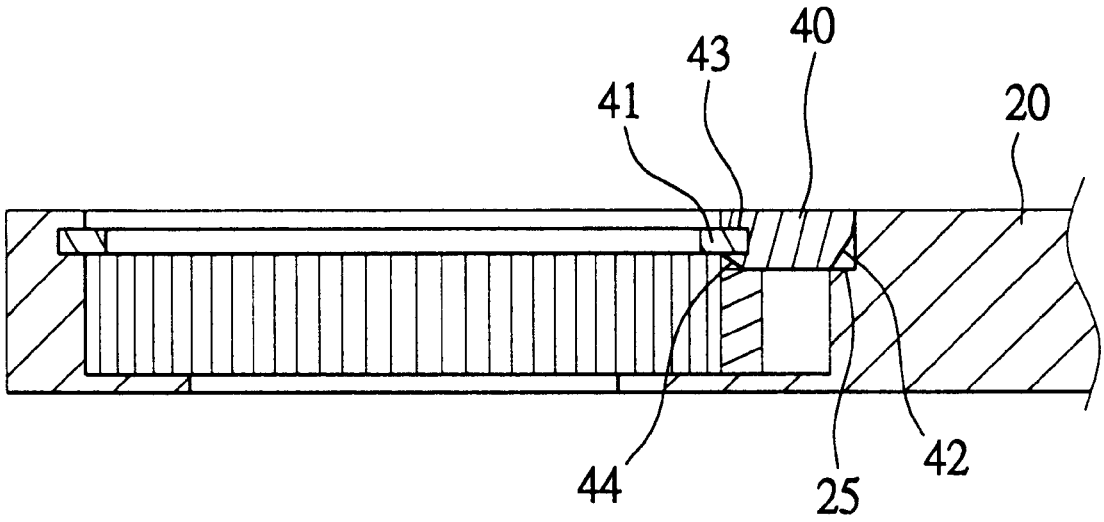
FIG. 4 is an operational view of the ratchet wrench structure as shown in FIG. 3.

In assembly, referring to FIG. 3 and 4 with reference to FIG. 2, the annular toothed block 26 is initially received in the receiving space 210 while the locking block 31 together with the spring 30 is received in the receiving chamber 22. The C-shaped snap 41 is then pressed into the receiving space 210 to be inserted into and secured in the annular groove 24. The arcuate cover 40 is then pressed toward the receiving chamber 22 as shown in FIG. 3 until the inclined face 44 is urged on the periphery of the C-shaped snap 41 whereby the arcuate cover 40 can be moved downward relative to the C-shaped snap 41 by guidance of the inclined face 44 until the C-shaped snap 41 is inserted into the arcuate groove 43 of the arcuate cover 40 as shown in FIG. 4. The arcuate cover 40 is then pushed by the elastic action of the C-shaped snap 41 toward the stepped portion 25 of the wrench body 20 such that the mating inclined surface 42 of the arcuate cover 40 is supported and secured on the stepped portion 25 of the wrench body 20, thereby accomplishing the assembly of the ratchet wrench structure.

Accordingly, the assembling work of the ratchet wrench structure does not need to additionally provide a screw for locking it, thereby facilitating the assembling and dismantling process of the ratchet wrench structure, and thereby greatly saving time for assembling and dismantling the ratchet wrench structure.

In operation, when the wrench body 20 is rotated clockwise as shown in FIG. 2, the locking block 31 is pushed toward the spring 30 by the annular toothed block 26 that is at a locked state and by the inner wall of the receiving chamber 22 that is rotated clockwise, so as to compress the spring 30 to generate a downward thrust, thereby accelerating the engaging teeth 32 of the locking block 31 to detach from the teeth 260 of the annular toothed block 26 so that the annular toothed block 26 that is at a locked state cannot be driven to rotate.

When the wrench body 20 is rotated counterclockwise as shown in FIG. 2, the locking block 31 is forced to be inserted into a gap defined between the annular toothed block 26 and the inner wall of the receiving chamber 22 by the annular toothed block 26 that is at a locked state and by the inner wall of the receiving chamber 22 that is rotated counterclockwise. In such a manner, the front end of the locking block 31 is locked, the locking block 31 is pivoted about the arcuate face 33 whereby the rear end of the locking block 31 is pulled up rapidly, while the spring 30 is extended due to its elasticity, thereby accelerating the engaging teeth 32 of the locking block 31 to engage the teeth 260 of the annular toothed block 26 so that the annular toothed block 26 that is at a locked state can be driven to rotate for operating a workpiece such as a hexagonal nut or the like.

It should be clear to those skilled in the art that further embodiments may be made without departing from the scope of the present invention.

What is claimed is:

1. A ratchet wrench structure comprising:

a wrench body (20) including a head portion (21) defining a receiving space (210), a receiving chamber (22) defined in said head portion (21) and located beside said receiving space (210), an annular groove (24) defined in said head portion (21) and located at an upper edge of said receiving space (210);

an annular toothed block (26) secured in said receiving space (210) of said wrench body (20) and having an outer periphery provided with a plurality of teeth (260);

a locking block (31) pivotally mounted in said receiving chamber (22) of said wrench body (20) and having one side provided with a plurality of engaging teeth (32) mating with said teeth (260) of said annular toothed block (26);

a spring (30) mounted in said receiving chamber (22) of said wrench body (20) and having a first end urged on an inner wall of said receiving chamber (22) of said wrench body (20) and a second end urged on a rear end of said locking block (31);

a cover (40) mounted in said receiving chamber (22) of said wrench body (20) for covering said locking block (31) and said spring (30) and defining an arcuate groove (43) mating with said annular groove (24) of said wrench body (20), an inclined face (44) provided on said cover and located under said arcuate groove (43); and a C-shaped snap (41) secured in and retained by said annular groove (24) of said wrench body (20) and said arcuate groove (43) of said cover (40), and rested on said annular toothed block (26).

2. The ratchet wrench structure in accordance with claim 1, wherein said head portion (21) of said wrench body (20) defines a recess (23) having a predetermined inclined angle and located at one side of said receiving chamber (22) for securing said first end of said spring (30) therein, whereby said spring (30) generates an angled pulling stress or pushing stress by means of said inclined angle of said recess (23) so that said locking block (31) can mate with said annular toothed block (26) more stably.

3. The ratchet wrench structure in accordance with claim 1, wherein said rear end of said locking block (31) is provided with a protruding stub (34) secured in said first end of said spring (30).

4. The ratchet wrench structure in accordance with claim 1, wherein said head portion (21) of said wrench body (20) is provided with a stepped portion (25) located at an upper edge of said receiving chamber (22) for stably supporting said cover (40).

5. The ratchet wrench structure in accordance with claim 1, wherein said locking block (31) has another side provided with an arcuate face (33) mating with said receiving chamber (22) of said wrench body (20).

* * * * *